US011898252B2

(12) United States Patent
Lee et al.

(10) Patent No.: US 11,898,252 B2
(45) Date of Patent: Feb. 13, 2024

(54) ALUMINUM-BASED ALLOY-PLATED STEEL SHEET HAVING EXCELLENT WORKABILITY AND CORROSION RESISTANCE, AND MANUFACTURING METHOD THEREFOR

(71) Applicant: POSCO, Pohang-si (KR)

(72) Inventors: Suk-Kyu Lee, Jeollanam-do (KR); Hyeon-Seok Hwang, Jeollanam-do (KR); Myung-Soo Kim, Jeollanam-do (KR); Kwang-Tai Min, Jeollanam-do (KR); Dae-Young Kang, Jeollanam-do (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 17/786,452

(22) PCT Filed: Dec. 18, 2020

(86) PCT No.: PCT/KR2020/018719
§ 371 (c)(1),
(2) Date: Jun. 16, 2022

(87) PCT Pub. No.: WO2021/125901
PCT Pub. Date: Jun. 24, 2021

(65) Prior Publication Data

US 2023/0026159 A1 Jan. 26, 2023

(30) Foreign Application Priority Data

Dec. 20, 2019 (KR) ..... 10-2019-0172300

(51) Int. Cl.
*C23C 2/12* (2006.01)
*C22C 21/00* (2006.01)
(Continued)

(52) U.S. Cl.
CPC ..... *C23C 2/12* (2013.01); *C22C 21/00* (2013.01); *C22C 38/02* (2013.01); *C22C 38/04* (2013.01);
(Continued)

(58) Field of Classification Search
None
See application file for complete search history.

(56) References Cited

U.S. PATENT DOCUMENTS 11,248,287 B2 * 2/2022 Oh ..... C22C 38/02
11,529,795 B2 * 12/2022 Oh ..... C22C 38/00
(Continued)

FOREIGN PATENT DOCUMENTS

CN 1301878 A 7/2001
CN 1436252 A 8/2003
(Continued)

OTHER PUBLICATIONS

European Search Report dated Nov. 24, 2022 issued in European Patent Application No. 20903509.6.
(Continued)

*Primary Examiner* — Daniel J. Schleis
(74) *Attorney, Agent, or Firm* — Morgan, Lewis & Bockius LLP

(57) ABSTRACT

The present disclosure relates to an aluminum alloy-plated steel sheet having excellent workability and corrosion resistance and a method for manufacturing the same, and more particularly, to an aluminum alloy-plated steel sheet preventing microcracks generated during hot forming and has excellent seizure resistance and corrosion resistance, and a method for manufacturing the same.

15 Claims, 2 Drawing Sheets

(51) Int. Cl.

| | |
|---|---|
| ***C22C 38/02*** | (2006.01) |
| ***C22C 38/04*** | (2006.01) |
| ***C23C 28/00*** | (2006.01) |
| ***C23C 2/28*** | (2006.01) |

(52) U.S. Cl.
CPC ..... *C23C 2/28* (2013.01); *C23C 2/29* (2022.08); *C23C 28/345* (2013.01)

(56) References Cited

U.S. PATENT DOCUMENTS

| | | | | |
|---|---|---|---|---|
| 2003/0155048 | A1 | 8/2003 | Zeizinger et al. | |
| 2018/0002797 | A1 | 1/2018 | Oh et al. | |
| 2019/0381764 | A1 | 12/2019 | Kang et al. | |
| 2021/0348257 | A1* | 11/2021 | Lee | C23C 2/40 |
| 2022/0049338 | A1* | 2/2022 | Oh | C22C 38/28 |
| 2023/0012544 | A1* | 1/2023 | Lee | C22C 38/14 |

FOREIGN PATENT DOCUMENTS

| | | | |
|---|---|---|---|
| EP | 2980260 | A1 | 2/2016 |
| EP | 3845682 | A1 | 7/2021 |
| JP | H06-101043 | A | 4/1994 |
| JP | H09-87859 | A | 3/1997 |
| JP | 2004-059968 | A | 2/2004 |
| JP | 2012-012649 | A | 1/2012 |
| JP | 2012-041610 | A | 3/2012 |
| JP | 2019-073778 | A | 5/2019 |
| KR | 10-1997-0043250 | A | 7/1997 |
| KR | 10-2014-0083814 | A | 7/2014 |
| KR | 10-2018-0022928 | A | 3/2018 |
| KR | 10-2019-0078001 | A | 7/2019 |
| KR | 10-2019-0078013 | A | 7/2019 |
| WO | 2017/017483 | A1 | 2/2017 |
| WO | 2018/117769 | A1 | 6/2018 |

OTHER PUBLICATIONS

International Search Report dated May 27, 2021 issued in International Patent Application No. PCT/KR2020/018719 (with English translation).

Chinese Office Action dated Apr. 1, 2023 issued in Chinese Patent Application No. 202080084521.3.

Japanese Office Action dated May 16, 2023 issued in Japanese Patent Application No. 2022-537898.

* cited by examiner

【FIG. 1】
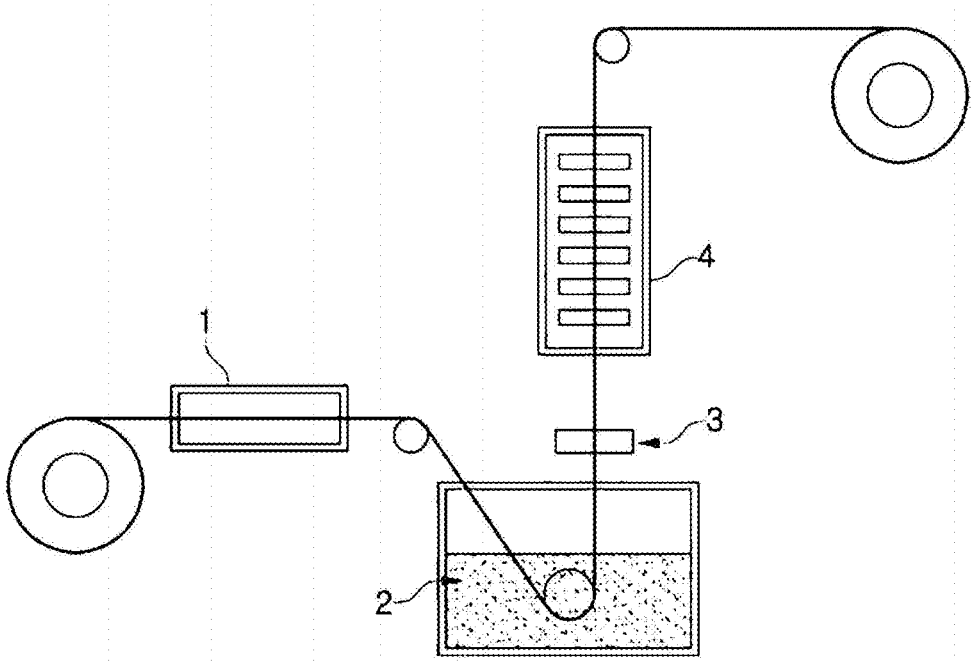
【FIG. 2】
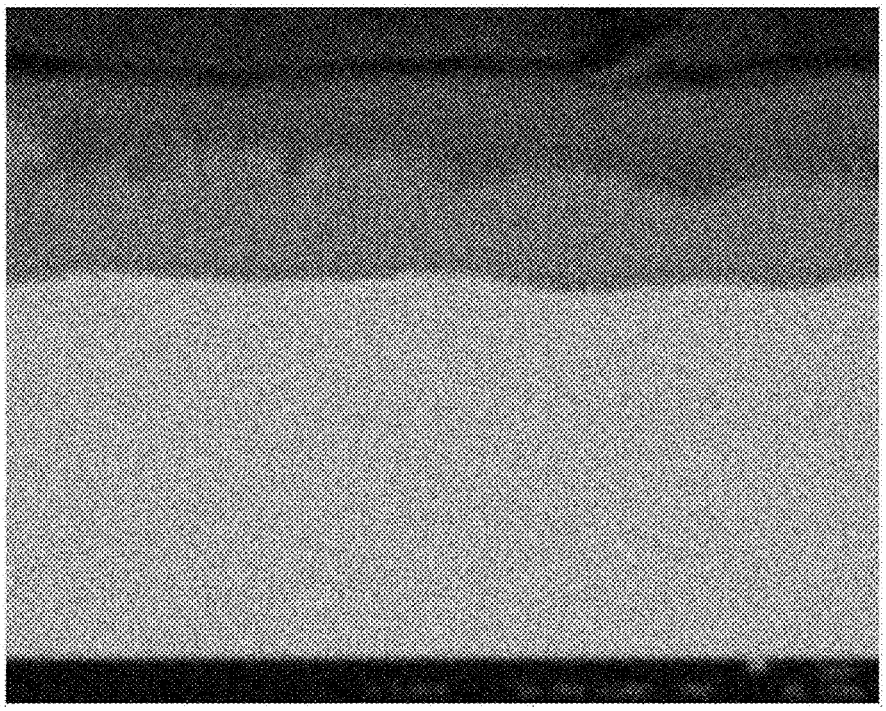

【FIG. 3】
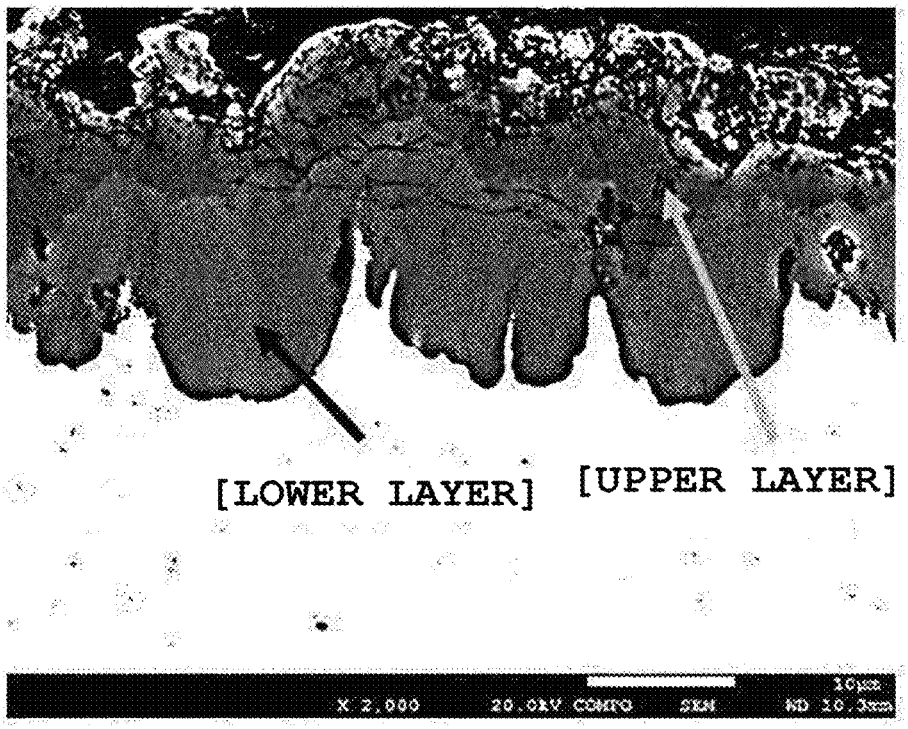
【FIG. 4】
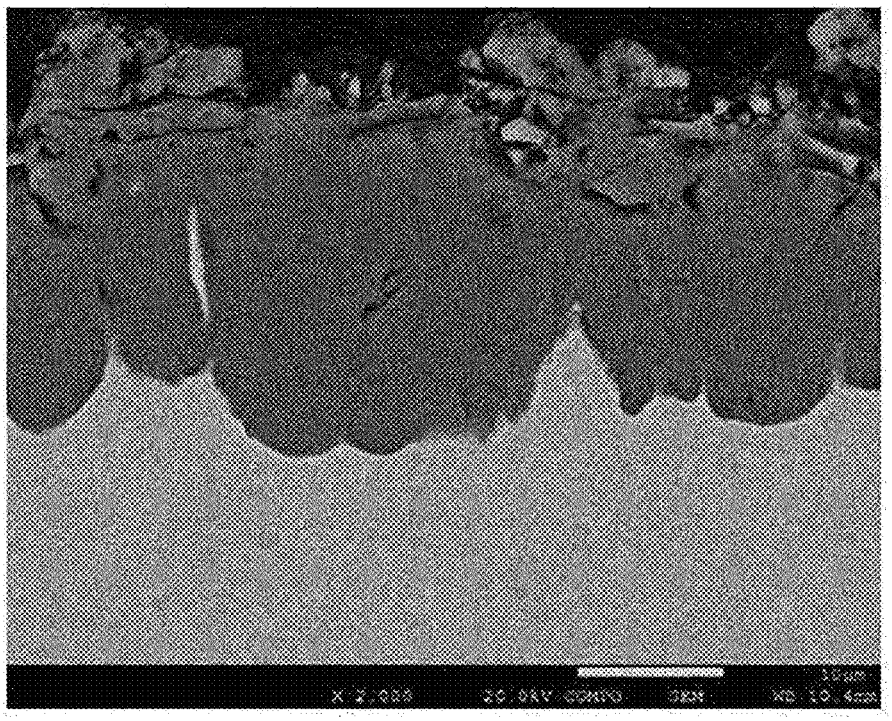

ALUMINUM-BASED ALLOY-PLATED STEEL SHEET HAVING EXCELLENT WORKABILITY AND CORROSION RESISTANCE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/018719, filed on Dec. 18, 2020, which in turn claims the benefit of Korean Application No. 10-2019-0172300, filed on Dec. 20, 2019, the entire disclosures of which applications are incorporated by reference herein.

TECHNICAL FIELD

The present disclosure relates to an aluminum alloy-plated steel sheet having excellent workability and corrosion resistance and a method for manufacturing the same.

BACKGROUND ART

In the related art, an aluminum (Al)-plated steel sheet or a zinc (Zn)-plated steel sheet has been used for hot forming, but there is a problem in that microcracks may be generated or corrosion resistance may be deteriorated due to an alloy phase formed during heat treatment. In addition, a plated layer may be liquefied during the hot forming and the liquefied plated layer is fused to a roll, and thus, the temperature may not be rapidly increased to 900° C., resulting in deterioration of productivity. In addition, in the case of the aluminum-plated steel sheet, since there is no sacrificial corrosion resistance of aluminum, corrosion resistance after processing may be problematic.

In order to improve corrosion resistance and hot formability, an aluminum alloy-plated steel sheet obtained by adding 4% or less of Si to a plating bath and alloying a plated layer at an alloying temperature of 700° C. for an alloying time of 20 seconds is disclosed in the related art.

However, since a long alloying time of 20 seconds is required under the above conditions, it is difficult to perform alloy treatment in an actual line, and strong cooling is required after alloying. In addition, as the content of Si is decreased, the temperature of the plating bath is about 700° C., which is significantly high. Thus, durability of a structure such as a sink roll dipped in the plating bath is remarkably deteriorated.

(Patent Document 1) Korean Patent Laid-open Publication No. 1997-0043250

DISCLOSURE

Technical Problem

An aspect of the present disclosure is to provide an aluminum alloy-plated steel sheet preventing microcracks generated during hot forming and has excellent seizure resistance and corrosion resistance, and a method for manufacturing the same.

An object of the present disclosure is not limited to the above description. Those skilled in the art to which the present disclosure pertains will have no difficulties in understanding additional objects of the present disclosure from the general contents of the specification of the present disclosure.

Technical Solution

According to an aspect of the present disclosure, an aluminum alloy-plated steel sheet includes:

a base steel sheet; and a single alloy-plated layer formed on the base steel sheet, wherein the alloy-plated layer contains, by wt %, 35 to 50% of Fe, 1 to 20% of Zn, 5% or less of Mn, less than 0.1% of Si, and a balance of Al and unavoidable impurities, and a ratio of an area occupied by the base steel sheet in a region from a surface roughness center line of the alloy-plated layer to 3/4t is 30% or more, where t is a distance from the surface roughness center line of the alloy-plated layer to the lowest line of the alloy-plated layer.

According to another aspect of the present disclosure, an aluminum alloy-plated steel sheet includes:

a base steel sheet; and an alloy-plated layer formed on the base steel sheet, wherein the alloy-plated layer includes:

a first alloy-plated layer that contains, by wt %, 35 to 50% of Fe, 1 to 20% of Zn, 5% or less of Mn, less than 0.1% of Si, and a balance of Al and unavoidable impurities; and a second alloy-plated layer that contains, by wt %, 30 to 40% of Fe, 1 to 22% of Zn, 2% or less of Mn, less than 0.1% of Si, and a balance of Al and unavoidable impurities, and a ratio of an area occupied by the base steel sheet in a region from a surface roughness center line of the alloy-plated layer to 3/4t is 30% or more, where t is a distance from the surface roughness center line of the alloy-plated layer to the lowest line of the alloy-plated layer.

According to another aspect of the present disclosure, a method for manufacturing an aluminum alloy-plated steel sheet used for hot press forming includes:

preparing a base steel sheet;

dipping the base steel sheet in an aluminum plating bath that contains, by wt %, 3 to 30% of Zn, less than 0.1% of Si, and a balance of Al and unavoidable impurities to obtain an aluminum-plated steel sheet;

performing cooling by supplying air heated to 200 to 300° C. to the aluminum-plated steel sheet after the aluminum plating to form an oxide film on a surface of the aluminum-plated steel sheet; and obtaining an aluminum alloy-plated steel sheet by on-line alloying in which heat treatment is performed continuously after the cooling while maintaining the aluminum-plated steel sheet in a heating temperature range of 650 to 750° C. for 1 to seconds.

According to another aspect of the present disclosure, there is provided a hot-formed member obtained by subjecting the aluminum alloy-plated steel sheet to hot press forming.

Advantageous Effects

As set forth above, according to the present disclosure, an aluminum alloy-plated steel sheet preventing microcracks generated during hot forming and has excellent seizure resistance and corrosion resistance, and a hot-formed member obtained using the same may be provided.

DESCRIPTION OF DRAWINGS

FIG. 1 schematically illustrates a manufacturing apparatus in which a manufacturing method is implemented according to an aspect of the present disclosure.

FIG. 2 is a photograph obtained by observing a cross section of an aluminum alloy-plated steel sheet corresponding to the related art in which about 7% of Si is contained and Zn is not contained with a scanning electron microscope (SEM).

FIG. 3 is a photograph obtained by observing a cross section of an aluminum alloy-plated steel sheet manufactured by Inventive Example 1 with a scanning electron microscope (SEM).

FIG. 4 is a photograph obtained by observing a cross section of an aluminum alloy-plated steel sheet manufactured by Inventive Example 6 with a scanning electron microscope (SEM).

BEST MODE FOR INVENTION

Hereinafter, the present disclosure will be described in detail. First, an aluminum alloy-plated steel sheet according to an aspect of the present disclosure will be described in detail.

In an aluminum alloy-plated steel sheet manufactured according to the related art, microcracks are generated in a hot forming process, deterioration of hot formability such as fusion to a roll occurs during hot forming, and corrosion resistance of the plated steel sheet is insufficient.

In order to solve these problems, 4% or less of Si is contained in a plating bath in the related art. However, in a case where a small amount of Si is contained in an Al plating bath as described above, since Si is contained in an Fe—Al alloy phase, diffusion of Fe is suppressed. Thus, alloying is not performed in a short time of 20 seconds or shorter, and as a temperature of the plating bath is excessively increased, it is not possible to solve problems such as deterioration of durability of a structure.

Therefore, as a result of examining examples for solving the above-described problems of the related art, the present inventors have found that the above-described problems of the related art may be solved by securing a specific amount or more of an area occupied by a base steel sheet to an upper side based on a line to be a specific point with respect to a distance between a surface of an alloy-plated layer and the lowest end of the alloy-plated layer in contact with a base material, thereby completing the present disclosure.

Specifically, the aluminum alloy-plated steel sheet according to the present disclosure includes a case where the alloy-plated layer is formed in a single layer and a case where the alloy-plated layer is formed in two layers. Hereinafter, the respective cases will be described separately.

[Case where Alloy-Plated Layer is Formed in Single Layer]

According to an aspect of the present disclosure, there is provided an aluminum alloy-plated steel sheet including:

a base steel sheet; and a single alloy-plated layer formed on the base steel sheet, wherein the alloy-plated layer contains, by wt %, 35 to 50% of Fe, 1 to 20% of Zn, 5% or less of Mn, less than 0.1% of Si, and a balance of Al and unavoidable impurities, and a ratio of an area occupied by the base steel sheet in a region from a surf ace roughness center line of the alloy-plated layer to 3/4t is 30% or more, where t is a distance from the surface roughness center line of the alloy-plated layer to the lowest line of the alloy-plated layer.

The aluminum alloy-plated steel sheet according to an aspect of the present disclosure may include a base steel sheet, and a single alloy-plated layer or two alloy-plated layers (a first alloy-plated layer and a second alloy-plated layer) formed on the base steel sheet, and the single alloy-plated layer or the two alloy-plated layers may be formed on one or both surfaces of the base steel sheet.

Meanwhile, according to an aspect of the present disclosure, when the base steel sheet is dipped and plated in an aluminum plating bath, and then, the plated steel sheet is subjected to a heat treatment process, Fe and/or Mn in the base steel sheet is diffused into the plated layer. As a result of such diffusion, the plated layer is alloyed, and through this, a single alloy-plated layer or two alloy-plated layers having a specific composition are formed on the base steel sheet.

Hereinafter, a case where the aluminum alloy-plated steel sheet according to an aspect of the present disclosure includes an alloy-plated layer formed in a single layer will be first described.

That is, in the case where the alloy-plated layer according to an aspect of the present disclosure is formed in a single layer, the alloy-plated layer may have a composition that contains, by wt %, 35 to 50% of Fe, 1 to 20% of Zn, 5% or less (including 0%) of Mn, less than 0.1% of Si (including 0%), and a balance of Al and unavoidable impurities.

Alternatively, according to an aspect of the present disclosure, in the case where the alloy-plated layer is formed in a single layer, the alloy-plated layer may have a composition that contains, by wt %, 35 to 50% of Fe, 1 to 20% of Zn, 5% or less (including 0%) of Mn, less than 0.1% (including 0%) of Si, and a balance of Al and unavoidable impurities.

In the single alloy-plated layer according to an aspect of the present disclosure, Zn plays a role in improving adhesion of the alloy-plated layer after alloy treatment, as well as improving seizure resistance and corrosion resistance of the plated steel sheet. Therefore, a content of Zn in the alloy-plated layer in the plated steel sheet of the present disclosure is preferably 1 to 20%. In the present disclosure, when the content of Zn in the alloy-plated layer is less than 1%, the effect of improving seizure resistance and corrosion resistance is not obtained, and when the content of Zn in the alloy-plated layer exceeds 20%, the adhesion of the plated layer after the alloy treatment is deteriorated.

Meanwhile, according to an aspect of the present disclosure, a lower limit of the content of Zn in the single alloy-plated layer may be preferably 5% and more preferably 10%. In addition, an upper limit of the content of Zn may be preferably 18% and more preferably 15%.

In addition, according to an aspect of the present disclosure, a content of Mn in the single alloy-plated layer may be 5% or less and may be 0%. That is, in the present disclosure, Mn present in the alloy-plated layer is Mn that is present in the base steel sheet and is introduced by the alloy treatment, and a lower limit of a content of Mn is not particularly limited. However, an upper limit of the content of Mn is preferably 5% or less in terms of securing plating properties to suppress occurrence of non-plating. In addition, the content of Mn in the single alloy-plated layer may be more preferably 2 to 5%.

In addition, according to an aspect of the present disclosure, a content of Si in the single alloy-plated layer may be less than 0.1% and may be 0%. That is, in the present disclosure, a hot-dip plating bath may contain an element such as Si as an additional element, and may not contain Si. Therefore, a lower limit thereof is not specifically limited. Meanwhile, the content of Si is preferably less than 0.1% in terms of securing crack resistance during processing described above. Meanwhile, an upper limit of the content of Si in the single alloy-plated layer may be more preferably 0.09% (that is, 0.09% or less).

In addition, according to an aspect of the present disclosure, due to the diffusion of Fe and/or Mn caused by the alloy treatment described above, in the single alloy-plated layer, it is preferable that a content of Al is 40 to 60 and a content of Fe is 35 to 50%. When the composition described above is satisfied, the seizure resistance and the corrosion resistance desired in the present disclosure may be secured, and the adhesion of the plated layer may be secured.

Meanwhile, according to an aspect of the present disclosure, the content of Al in the single alloy-plated layer described above is more preferably 43 to 60% in terms of securing plating adhesion.

In addition, according to an aspect of the present disclosure, a thickness of the single alloy-plated layer may be 5 to 25 μm. When the thickness of the alloy-plated layer is 5 μm or more, corrosion resistance may be secured, and when the thickness of the alloy-plated layer is 25 μm less, weldability may be secured. Therefore, in the present disclosure, the thickness of the alloy-plated layer is preferably 5 to 25 μm, and more preferably, a lower limit of the thickness of the alloy-plated layer may be 10 μm, and an upper limit of the thickness of the alloy-plated layer may be 20 μm.

Meanwhile, according to an aspect of the present disclosure, as for the single alloy-plated layer, Fe and/or Mn in the base steel sheet is diffused into an aluminum-plated layer in which contents of Al and Zn are high by the alloy treatment after the plating in the manufacturing process described above. As a result, an alloy-plated layer mainly formed of an intermetallic compound of Fe and Al may be formed.

Specifically, according to an aspect of the present disclosure, in the case where the alloy-plated layer described above is formed in a single layer, an alloy phase of the Fe—Al intermetallic compound mainly constituting the alloy-plated layer is preferably $Fe_2Al_5$. That is, the single alloy-plated layer may contain 80% or more of an $Fe_2Al_5$ alloy phase, and more preferably may contain 90% or more of an $Fe_2Al_5$ alloy phase. Therefore, the single alloy-plated layer may be formed of an alloy phase in which $Fe_2Al_5$ is mainly solid-dissolved (that is, $Fe_2Al_5$ is 80% or more) and Zn, Mn, and/or Si, and the like are solid-dissolved.

In the present specification, being formed of the alloy phase implies that unavoidable impurities may be contained and other components are contained in a range where the object of the present disclosure is not impaired.

Meanwhile, in the case where the alloy-plated layer is formed in a single layer, in the aluminum alloy-plated steel sheet according to the present disclosure, a ratio (As) of an area occupied by the base steel sheet in a region from a surface roughness center line of the alloy-plated layer to 3/4t is 30% or more, where t is a distance from the surface roughness center line of the alloy-plated layer to the lowest line of the alloy-plated layer.

In the present specification, the lowest line of the alloy-plated layer refers to a line drawn at the lowest end of the alloy-plated layer in a direction perpendicular to a thickness direction of the steel sheet. In addition, according to an aspect of the present disclosure, the lowest line may refer to a line drawn to be horizontal with the surface roughness center line.

Specifically, the case where the alloy-plated layer according to the present disclosure is formed in a single layer is illustrated in FIG. 4. As illustrated in FIG. 4, in the single alloy-plated layer, an interface between the alloy-plated layer and the base steel sheet is formed in a sawtooth shape so that a ratio (As) of an area occupied by the base steel sheet in a region from a surface roughness center line of the alloy-plated layer to 3/4t is 30% or more.

A boundary between the alloy-plated layer according to an aspect of the present disclosure and the base steel sheet that is a base material is formed in the sawtooth shape as described above, such that generation of cracks may be suppressed during the processing. Therefore, excellent crack resistance may be secured.

In the case where the alloy-plated layer is formed in a single layer, an upper limit of a value of As may not be specifically limited because the crack resistance is more excellent as the value is greater. However, the upper limit of the value of As may be more preferably 80% (most preferably 60%).

In the present disclosure, forming the alloy-plated layer on the base steel sheet means that the alloy-plated layer is formed so as to be in contact with the base steel sheet. In addition, in the present disclosure, forming the alloy-plated layer in a single layer means that a single layer is formed as the alloy-plated layer, but does not mean another layer cannot be provided on the alloy-plated layer.

[Case where Alloy-Plated Layer is Formed in Two Layers]

Meanwhile, a case where the aluminum alloy-plated steel sheet according to another aspect of the present disclosure includes an alloy-plated layer formed in two layers will be first described.

Specifically, according to another aspect of the present disclosure, there is provided an aluminum alloy-plated steel sheet including:

a base steel sheet; and an alloy-plated layer formed on the base steel sheet, wherein the alloy-plated layer includes:

a first alloy-plated layer that contains, by wt %, 35 to 50% of Fe, 1 to 20% of Zn, 5% or less of Mn, less than 0.1% of Si, and a balance of Al and unavoidable impurities; and a second alloy-plated layer that contains, by wt %, 30 to 40% of Fe, 1 to 22% of Zn, 2% or less of Mn, less than 0.1% of Si, and a balance of Al and unavoidable impurities, and a ratio of an area occupied by the base steel sheet in a region from a surface roughness center line of the alloy-plated layer to 3/4t is 30% or more, where t is a distance from the surface roughness center line of the alloy-plated layer to the lowest line of the alloy-plated layer.

The description of the case where the single alloy-plated layer described above is provided may also be applied to the case where the alloy-plated layer is formed in two layers, except that the first alloy-plated layer and the second alloy-plated layer are formed.

According to an aspect of the present disclosure, in a case where the alloy-plated layer is formed in two layers including a first alloy-plated layer and a second alloy-plated layer, the first alloy-plated layer contains, by wt %, 35 to 50% of Fe, 1 to 20% of Zn, 5% or less (including 0%) of Mn, less than 0.1% (including 0%) of Si, and a balance of Al and unavoidable impurities, and the second alloy-plated layer contains, by wt %, 30 to 40% of Fe, 1 to 22% of Zn, 2% or less (including 0%) of Mn, less than 0.1% (including 0%) of Si, and a balance of Al and unavoidable impurities.

Specifically, according to an aspect of the present disclosure, the first alloy-plated layer, which is an alloy-plated layer formed on the base steel sheet, may contain, by wt %, 35 to 50% of Fe, 1 to 20% of Zn, 5% or less (including 0%) of Mn, less than 0.1% (including 0%) of Si, and a balance of Al, and may further contain unavoidable impurities and other elements in a range where the object of the present disclosure is not impaired. Alternatively, according to an aspect of the present disclosure, the first alloy-plated layer may contain, by wt %, 35 to 50% of Fe, 1 to 20% of Zn, 5% or less of Mn, less than 0.1% (including 0%) of Si, and a balance of Al and unavoidable impurities. In addition, according to an aspect of the present disclosure, a content of Al in the first alloy-plated layer may be 40 to 60% and more preferably 43 to 60% in terms of wt %. Meanwhile, when the above content of Al is satisfied in the first alloy-plated layer, desired seizure resistance and corrosion resistance and adhesion of the plated layer may be easily secured.

Similarly, according to an aspect of the present disclosure, a content of Fe in the first alloy-plated layer is preferably 35 to 50% in terms of wt %, and when the above content of Fe is satisfied in the first alloy-plated layer, desired seizure resistance and corrosion resistance and adhesion of the plated layer may be easily secured.

According to an aspect of the present disclosure, the second alloy-plated layer, which is an alloy-plated layer formed on the first alloy-plated layer and is distinguished from the first alloy-plated layer, may contain, by wt %, 30 to 40% of Fe, 1 to 22% of Zn, 2% or less (including 0%) of Mn, less than 0.1% (including 0%) of Si, and a balance of Al, and may further contain unavoidable impurities and other elements in a range where the object of the present disclosure is not impaired. Alternatively, according to an aspect of the present disclosure, the second alloy-plated layer may contain, by wt %, 30 to 40% of Fe, 1 to 22% of Zn, 2% or less (including 0%) of Mn, less than 0.1% (including 0%) of Si, and a balance of Al and unavoidable impurities.

In addition, according to an aspect of the present disclosure, a content of Al in the second alloy-plated layer may be 40 to 65%, more preferably 44 to 65%, and still more preferably 44 to 60%, in terms of wt %. Meanwhile, when the above content of Al is satisfied in the second alloy-plated layer, desired seizure resistance and corrosion resistance and adhesion of the plated layer may be easily secured.

In addition, according to an aspect of the present disclosure, a content of Fe in the second alloy-plated layer is preferably 30 to 40% and more preferably 32 to 40% in terms of wt %. When the above content of Fe is satisfied in the second alloy-plated layer, desired seizure resistance and corrosion resistance and adhesion of the plated layer may be easily secured.

That is, according to an aspect of the present disclosure, each of the first alloy-plated layer and the second alloy-plated layer has the specific composition described above, such that the desired effect of improving not only the seizure resistance and the corrosion resistance of the plated steel sheet but also the adhesion of the plated layer may be exhibited in the present disclosure. Therefore, in a case where a content of any one component is not satisfied as the composition of each of the first alloy-plated layer and the second alloy-plated layer, excellent seizure resistance and corrosion resistance and adhesion by the present disclosure are not obtained.

In addition, according to an aspect of the present disclosure, a content of Si in each of the first alloy-plated layer and the second alloy-plated layer may be less than 0.1% and may be 0%. That is, in the present disclosure, a hot-dip plating bath may contain an element such as Si as an additional element, and may not contain Si. Therefore, a lower limit thereof is not specifically limited. Meanwhile, the content of Si is preferably less than 0.1% in terms of securing crack resistance during processing described above. Meanwhile, an upper limit of the content of Si in the single alloy-plated layer may be more preferably 0.09% (that is, 0.09% or less).

In particular, according to an aspect of the present disclosure, in each of the first alloy-plated layer and the second alloy-plated layer, Zn plays an important role in improving the adhesion of the plated layer after alloy treatment, as well as improving seizure resistance and corrosion resistance of the plated steel sheet. Therefore, in the plated steel sheet of the present disclosure, it is preferable that a content of Zn in the first alloy-plated layer is 1 to 20% and a content of Zn in the second alloy-plated layer is 1 to 22%. In the present disclosure, when a lower limit of the content of Zn in each of the first alloy-plated layer and the second alloy-plated layer is not satisfied, the effect of improving seizure resistance and corrosion resistance is not obtained. In addition, when an upper limit of the content of Zn in each of the first alloy-plated layer and the second alloy-plated layer is not satisfied, the adhesion of the plated layer after the alloy treatment is deteriorated.

According to an aspect of the present disclosure, it is more preferable that the content of Zn in the first alloy-plated layer is 1 to 20% and the content of Zn in the second alloy-plated layer is 1.5 to 22%.

In addition, according to an aspect of the present disclosure, the content of Zn in the second alloy-plated layer may be higher than the content of Zn in the first alloy-plated layer. This is because Zn in the second alloy-plated layer located far from the base steel sheet is concentrated as a result of diffusion of Fe in the base steel sheet while the base steel sheet is dipped in the plating bath and then the base steel sheet is subjected to cooling and alloy treatment processes.

In addition, according to an aspect of the present disclosure, a content of Mn in the first alloy-plated layer may be higher than a content of Mn in the second alloy-plated layer. In addition, according to an aspect of the present disclosure, a content of Fe in the first alloy-plated layer may be higher than a content of Fe in the second alloy-plated layer.

According to an aspect of the present disclosure, after the base steel sheet is dipped and plated in the aluminum plating bath in the manufacturing process described above, Fe and/or Mn in the base steel sheet is diffused into the aluminum-plated layer by the alloy heat treatment. As a result, a first alloy-plated layer and a second alloy-plated layer that are mainly formed of an intermetallic compound of Fe and Al are formed.

Meanwhile, although not limited thereto, according to an aspect of the present disclosure, it is preferable that the first alloy-plated layer may mainly contain an $Fe_2Al_5$ alloy phase and the second alloy-plated layer may mainly contain an $FeAl_3$ alloy phase. Specifically, according to an aspect of the present disclosure, the first alloy-plated layer may contain 80% or more of an $Fe_2Al_5$ alloy phase, and the second alloy-plated layer may contain 80% or more of an $FeAl_3$ alloy phase.

In addition, according to an aspect of the present disclosure, the first alloy-plated layer may contain 90% or more of an $Fe_2Al_5$ alloy phase, and the second alloy-plated layer may contain 90% or more of an $FeAl_3$ alloy phase. In addition, according to an aspect of the present disclosure, the first alloy-plated layer may be formed of an alloy phase in which $Fe_2Al_5$ is mainly solid-dissolved (that is, $Fe_2Al_5$ is 80% or more) and Zn, Mn, and/or Si, and the like are solid-dissolved, and the second alloy-plated layer may be formed of an alloy phase in which $FeAl_3$ is mainly solid-dissolved (that is, $FeAl_3$ is 80% or more) and Zn, Mn, and/or Si, and the like are solid-dissolved.

That is, in the present specification, being formed of the alloy phase implies that unavoidable impurities may be contained and other components are contained in a range where the object of the present disclosure is not impaired.

Meanwhile, in the case where the alloy-plated layer is formed in two layers, in the aluminum alloy-plated steel sheet according to the present disclosure, a ratio (As) of an area occupied by the base steel sheet in a region from a surface roughness center line of the alloy-plated layer to 3/4t is 30% or more, where t is a distance from the surface roughness center line of the alloy-plated layer to the lowest line of the alloy-plated layer.

In the present specification, the lowest line of the alloy-plated layer refers to a line drawn at the lowest end of the alloy-plated layer in a direction perpendicular to a thickness direction of the steel sheet. In addition, according to an aspect of the present disclosure, the lowest line of the alloy-plated layer may refer to a line drawn to be horizontal with the surface roughness center line.

Specifically, the case where the alloy-plated layer according to the present disclosure is formed in two layers is illustrated in FIG. 3, and as illustrated in FIG. 3, an interface between the alloy-plated layer and the base steel sheet is formed in a sawtooth shape so that a ratio (As) of an area occupied by the base steel sheet in a region from a surface roughness center line of the alloy-plated layer to 3/4t is 30% or more.

A boundary between the alloy-plated layer according to an aspect of the present disclosure and the base steel sheet that is a base material is formed in the sawtooth shape as described above, such that generation of cracks may be suppressed during the processing. Therefore, excellent crack resistance may be secured.

In this case, an upper limit of a value of As may not be specifically limited because the crack resistance is more excellent as the value is greater. However, the upper limit of the value of As may be more preferably 80%.

Meanwhile, in the case where the alloy-plated layer is formed in two layers, the boundary between the alloy plated layer and the base steel sheet described above may refer to a boundary between the first alloy-plated layer and the base steel sheet because the first alloy-plated layer is formed on the base steel sheet that is a base material.

In addition, according to an aspect of the present disclosure, a thickness of the first alloy-plated layer may be 1 to 25 μm, and a thickness of the second alloy-plated layer may be 3 to 20 μm. According to an aspect of the present disclosure, when the thickness of the first alloy-plated layer is 1 μm or more, the corrosion resistance may be exhibited, and when the thickness of the first alloy-plated layer is 25 μm or less, the adhesion may be secured. In addition, when the thickness of the second alloy-plated layer is 3 μm or more, the corrosion resistance may be exhibited, and when the thickness of the second alloy-plated layer is 25 μm or less, the adhesion may be secured.

Meanwhile, in the present disclosure, forming the second alloy-plated layer on the first alloy-plated layer means that the second alloy-plated layer is formed so as to be in contact with the first alloy-plated layer.

In addition, according to an aspect of the present disclosure, in all the case where the alloy-plated layer is formed in a single layer and the case where the alloy-plated layer is formed in two layers, the base steel sheet included in the aluminum-plated steel sheet is a steel sheet for hot press forming and is not particularly limited as long as it is used for hot press forming.

However, as a non-limiting example, a steel sheet containing 1 to 25% of Mn may be used as the base steel sheet. Alternatively, a base steel sheet having a composition that contains, by wt %, 0.05 to 0.3% of C, 0.1 to 1.5% of Si, 0.5 to 8% of Mn, 50 ppm or less of B, and a balance of Fe and unavoidable impurities may be used as the base steel sheet.

That is, according to the present disclosure, it is possible to provide a plated steel sheet that may prevent seizure of the plated layer to be attached to a press die or a roll, which is generated during the hot forming, and may have excellent corrosion resistance and excellent adhesion of the plated layer.

[Method for Manufacturing Aluminum Alloy-Plated Steel Sheet]

Hereinafter, an example of a method for manufacturing an aluminum alloy-plated steel sheet used for hot press forming according to an aspect of the present disclosure will be described. However, the following method for manufacturing an aluminum alloy-plated steel sheet for hot press forming is merely one example, and the aluminum alloy-plated steel sheet for hot press forming of the present disclosure does not necessarily have to be manufactured by the present manufacturing method.

According to another aspect of the present disclosure, there is provided a method for manufacturing an aluminum alloy-plated steel sheet used for hot press forming, the method including:

preparing a base steel sheet;

dipping the base steel sheet in an aluminum plating bath that contains, by wt %, 3 to 30% of Zn, less than 0.1% of Si, and a balance of Al and unavoidable impurities to obtain an aluminum-plated steel sheet;

performing cooling by supplying air heated to 200 to 300° C. to the aluminum-plated steel sheet after the aluminum plating to form an oxide film on a surface of the aluminum-plated steel sheet; and obtaining an aluminum alloy-plated steel sheet by on-line alloying in which heat treatment is performed continuously after the cooling while maintaining the aluminum-plated steel sheet in a heating temperature range of 650 to 750° C. for 1 to 20 seconds.

First, a base steel sheet is prepared to manufacture an aluminum alloy-plated steel sheet. The same description may apply to the base steel sheet.

Next, the aluminum alloy-plated steel sheet according to an aspect of the present disclosure may be obtained by subjecting a surface of the base steel sheet to hot-dip aluminum plating using an aluminum plating bath that contains, by wt %, 3 to 30% of Zn, less than 0.1% of Si, and a balance of Al and unavoidable impurities, and performing on-line alloy treatment in which cooling is performed continuously after the plating process and then heat treatment is immediately performed.

Specifically, the plating is performed by dipping the base steel sheet in a hot-dip aluminum plating bath. Meanwhile, according to an aspect of the present disclosure, the plating bath may be a hot-dip aluminum alloy plating bath having a composition that contains 3 to 30% of Zn, less than 0.1% of Si, and a balance of Al and unavoidable impurities, and more preferably, may contain 3 to 30% of Zn, less than 0.1% of Si, and 70 to 97% of Al, and may also contain unavoidable impurities.

In addition, according to an aspect of the present disclosure, the aluminum plating bath may further contain an additional element in a range where the object of the present disclosure is not impaired.

In addition, according to an aspect of the present disclosure, the hot-dip aluminum alloy plating bath may contain 3 to 30% of Zn, less than 0.1% of Si, 70 to 97% of Al, and unavoidable impurities.

According to an aspect of the present disclosure, it is preferable that the aluminum plating bath contains, by wt %, 3 to 30% of Zn to be added. When a content of Zn exceeds 30%, dust and the like are generated due to a large amount of ash generated in the plating bath, which causes deterioration of workability. In addition, when the content of Zn is less than 3%, a melting point of the plating bath is not significantly decreased, and Zn is evaporated during alloying, such that Zn does not remain in the plated layer and the corrosion resistance is not improved.

However, in order to maximize the effect of the present disclosure, a lower limit of the content of Zn is preferably 5% and more preferably 10%. Similarly, in order to maximize the effect of the present disclosure, an upper limit of the content of Zn is preferably 25% and more preferably 20%.

Meanwhile, according to an aspect of the present disclosure, it is preferable that the temperature of the plating bath is managed to a temperature higher than the melting point (Tb) of the plating bath by about 20 to 50° C. (that is, to a range of Tb+20° C. to Tb+50° C.). When the temperature of the plating bath is controlled to Tb+20° C. or higher, a deposition amount of plating may be controlled due to fluidity of the plating bath, and when the temperature of the plating bath is controlled to Tb+50° C. or lower, corrosion of a structure in the plating bath may be prevented.

In addition, according to an aspect of the present disclosure, a plating weight (deposition amount on the plated layer per surface) in the plating may be 20 to 100 g/m 2 per surface, and may be controlled by dipping the base steel sheet in the hot-dip aluminum plating bath and applying an air wiping process. When the plating weight in the plating is 20 $g/m^2$ or more per surface, the effect of the corrosion resistance may be exhibited, and when the plating weight in the plating is 100 $g/m^2$ or less per surface, the effect of securing the adhesion may be exhibited.

Subsequently, cooling may be performed by supplying air heated to 200 to 300° C. to the aluminum-plated steel sheet after the aluminum plating to form an oxide film on a surface of the aluminum-plated steel sheet. The cooling is important in the present disclosure in that it is a means for forming a uniform alloy layer. That is, when performing cooling, air heated to 200 to 300° C. is supplied to the aluminum-plated steel sheet to expose the aluminum-plated steel sheet to the air, such that an oxide film (aluminum oxide film: $AlO_x$) is formed on the surface of the aluminum-plated steel sheet.

According to an aspect of the present disclosure, as described above, before alloy treatment, an oxide film may be formed on the surface of the aluminum-plated steel sheet at a thickness of 10% or more (more preferably 10% or more and 20% or less) of the entire thickness of the hot-dip aluminum-plated layer. As described above, the oxide film is formed at the thickness of 10% or more, such that volatilization of Zn contained in the plated layer may be prevented during the alloy treatment. Therefore, excellent seizure resistance and corrosion resistance and excellent adhesion of the plated layer may be secured.

Next, on-line alloy treatment in which heat treatment is immediately performed continuously after the cooling described above may be performed. Fe and/or Mn in the base steel sheet is diffused into the aluminum-plated layer by such alloy heat treatment, such that the plated layer may be alloyed.

Specifically, in the present disclosure, an alloy heat treatment temperature may be in a range of 650 to 750° C., and a maintaining time may be 1 to 20 seconds.

In the present disclosure, the on-line alloy treatment refers to a process of performing heat treatment by increasing the temperature after the hot-dip aluminum plating, as illustrated in a schematic view illustrated in FIG. 1. In the on-line alloy heat treatment method according to the present disclosure, the heat treatment for alloying is started before the plated layer is cooled and hardened after the hot-dip aluminum plating, and thus, the alloying may be performed in a short time. In a plated layer component system of an aluminum-plated steel sheet known in the related art, sufficient alloying is not completed in a short time because an alloying rate is slow, and thus, it is difficult to apply the on-line alloying method in which heat treatment is performed immediately after the plating. However, in the present disclosure, the composition, manufacturing conditions, and the like of the plating bath that affect the alloying rate are controlled, such that the aluminum-plated layer may be alloyed in spite of a relatively short heat treatment time of 1 to 20 seconds.

Meanwhile, when the alloy heat treatment temperature is based on a temperature of the surface of the steel sheet to be subjected to heat treatment and the heat treatment temperature is lower than 650° C., the plated layer may be insufficiently alloyed. On the other hand, when the heat treatment temperature is higher than 750° C., a problem may occur in cooling of the plated steel sheet, resulting in deterioration of the plating adhesion.

Meanwhile, according to an aspect of the present disclosure, when the alloy heat treatment temperature is controlled, the composition of the alloy-plated layer varies. When the alloy heat treatment temperature is 650 to 680° C., the alloy-plated layer is formed in two layers (corresponding to the first alloy-plated layer and the second alloy-plated layer described above). On the other hand, when the alloy heat treatment temperature is 680 to 750° C., the alloy-plated layer is formed in a single layer.

In addition, according to an aspect of the present disclosure, the maintaining time during the alloy heat treatment may be in a range of 1 to 20 seconds. In the present disclosure, the maintaining time refers to a time during which the heating temperature (including a deviation of ±10° C.) is maintained in the steel sheet. When the maintaining time is 1 second or longer, the alloying may be sufficient, and when the maintaining time is 20 seconds or shorter, productivity may be secured.

According to an aspect of the present disclosure, in order to further improve the effect of the present disclosure, a lower limit of the maintaining time during the alloy heat treatment may be 1 second, and more preferably, may be 3 seconds. Similarly, an upper limit of the maintaining time during the alloy heat treatment may be 20 seconds, and more preferably, may be 10 seconds.

As described above, the diffusion of Fe is suppressed by containing Si in the related art, such that the alloying is not performed in a short time of 20 seconds or shorter. On the other hand, according to the present disclosure, the composition of the plating bath and the conditions during the alloy heat treatment are controlled, such that the alloying may be performed in a relatively short time of 20 seconds or shorter.

Meanwhile, the method for manufacturing an aluminum alloy-plated steel sheet according to an aspect of the present disclosure may further include, after the alloy treatment, performing cooling.

According to an aspect of the present disclosure, the cooling may be performed on the steel sheet discharged in the alloy treatment to 300° C. or lower at an average cooling rate of 15 to 25° C./s. Meanwhile, the cooling may be air cooling or mist cooling, and according to an aspect of the present disclosure, the cooling may be most preferably air cooling and mist cooling. According to an aspect of the present disclosure, when the average cooling rate is 15° C. or higher, the temperature of the steel sheet is cooled to 300°

C. or lower to prevent adsorption on the roll, and when the average cooling rate is or less, an effect of increasing a working speed is exhibited.

In addition, according to an aspect of the present disclosure, the cooling may be performed for 6 to 30 seconds, and when the cooling time is set to 6 seconds or longer, the effect of cooling the steel sheet to a desired temperature may be exhibited, and when the cooling time is set to 30 seconds or shorter, productivity may be maximized and the effect of cooling the steel sheet to a desired temperature may be exhibited.

Meanwhile, according to an aspect of the present disclosure, in the plated steel sheet manufactured by the present disclosure, the content of Fe in the alloy-plated layer may be represented by the following Relational Expression 1, and the heat treatment temperature and the content of Zn in the plating bath during the alloying are controlled to appropriate ranges, such that excellent seizure resistance and corrosion resistance and/or adhesion of the plated layer may be easily exhibited.

$$150-{}^{+}0.4\times[T]+3.3\times10-4\times[T]^2-0.38\times[\text{wt \% Zn}]\leq[\text{wt \% Fe}]\leq180-0.4\times[T]+3.3\times10-4\times[T]^2-0.38\times[\text{wt \% Zn}] \quad \text{[Relational Expression 1]}$$

(In Relational Expression 1, [T] represents the alloy heat treatment temperature (° C.), [wt % Zn] represents the content of Zn wt % in the plating bath, and [wt % Fe] represents the content of Fe wt % in the alloy-plated layer.)

In addition, according to another aspect of the present disclosure, there is provided a hot-formed member obtained by subjecting the aluminum alloy-plated steel sheet to hot press forming.

Methods generally used in the art may be used in the hot press forming. For example, the plated steel sheet may be heated in a temperature range of 800 to 950° C. for 3 to 10 minutes, and then, the plated steel sheet may be subjected to hot forming into a desired shape using a press, but the present disclosure is not limited thereto.

In addition, a composition of a base steel sheet of the hot press-formed member may be the same as the composition of the base steel sheet described above.

MODE FOR INVENTION

Hereinafter, the present disclosure will be described in more detail with reference to Examples. However, the following Examples are provided to illustrate and describe the present disclosure in detail, but are not intended to limit the scope of the present disclosure. This is because the scope of the present disclosure is determined by contents disclosed in the claims and contents reasonably inferred therefrom.

Experimental Example 1

First, after a cold-rolled steel sheet for hot-press forming having the composition shown in Table 1 and a thickness of 1.2 mm was prepared as a base steel sheet, the base steel sheet was dipped and ultrasonically cleaned to remove substances such as rolling oil present on a surface.

Thereafter, the base steel sheet was subjected to heat treatment in a furnace maintained in a reducing atmosphere at an annealing temperature of 800° C. for an annealing time of 50 seconds, and then, the base steel sheet was dipped in a plating bath under the composition of the plating bath and the temperature conditions of the plating bath shown in Table 2, thereby performing aluminum plating. When the base steel sheet was dipped in the plating bath, the dipping temperature was maintained at the same temperature of the plating bath, and the temperature of the plating bath was maintained at a temperature that was collectively increased by 40° C. with respect to a melting point (Tb) of each plating component system. In order for comparison of alloying, the plating weight was constantly maintained at 60 g/m$^2$ per surface using air wiping.

Subsequently, cooling was performed by supplying air heated to 200 to 300° C. to the aluminum-plated steel sheet. Thereafter, alloy heat treatment was performed under the alloy heat treatment conditions shown in Table 2, and then, the steel sheet was cooled by air cooling, thereby manufacturing an aluminum alloy-plated steel sheet.

TABLE 1

| Element | C | Si | Mn | Al | Ti | B | Fe |
|---|---|---|---|---|---|---|---|
| Content (%) | 0.22 | 0.25 | 1.3 | 0.03 | 0.03 | 25 ppm | bal. |

TABLE 2

| | Composition of plating bath (wt %) | | Alloying | |
|---|---|---|---|---|
| | | | Temperature | Time |
| Remarks | Al | Zn | [° C.] | [second] |
| Comparative Example 1 | 100 | — | 750 | 20 |
| Inventive Example 1 | bal. | 3 | 700 | 7 |
| Comparative Example 2 | bal. | 5 | 630 | 30 |
| Inventive Example 2 | bal. | 5 | 650 | 10 |
| Inventive Example 3 | bal. | 5 | 680 | 10 |
| Inventive Example 4 | bal. | 5 | 750 | 5 |
| Comparative Example 3 | bal. | 20 | 630 | 20 |
| Inventive Example 5 | bal. | 20 | 650 | 10 |
| Inventive Example 6 | bal. | 20 | 680 | 5 |
| Inventive Example 7 | bal. | 20 | 750 | 3 |
| Comparative Example 4 | bal. | 30 | 630 | 15 |
| Inventive Example 8 | bal. | 30 | 650 | 10 |
| Inventive Example 9 | bal. | 30 | 680 | 7 |
| Inventive Example 10 | bal. | 30 | 750 | 3 |
| Comparative Example 5 | bal. | 32 | 630 | 25 |
| Comparative Example 6 | bal. | 32 | 650 | 25 |
| Comparative Example 7 | bal. | 32 | 680 | 20 |
| Comparative Example 8 | bal. | 32 | 750 | 10 |

TABLE 3

| | Case where alloy-plated layer is single layer or first alloy-plated layer | | | | | Second alloy-plated layer | | | | | |
|---|---|---|---|---|---|---|---|---|---|---|---|
| | Component [wt %] | | | | Thickness | Component [wt %] | | | | Thickness | |
| Remarks | Al | Zn | Mn | Fe | [μm] | Al | Zn | Mn | Fe | [μm] | As* |
| Comparative Example 1 | bal | | 2 | 45 | 10 | bal | 0.0 | 1.5 | 0 | 12 | 18 |
| Inventive Example 1 | bal | 1 | 0 | 46 | 10 | bal | 1.5 | 1 | 38 | 5 | 80 |
| Comparative Example 2 | bal | 2 | 0.3 | 44 | 10 | bal | 1.0 | 0.1 | 1 0 | 15 | 15 |
| Inventive Example 2 | bal | 2 | 1 | 44 | 1 | bal | 4.0 | 0.3 | 39 | 20 | 70 |
| Inventive Example 3 | bal | 2 | 1 | 45 | 5 | bal | 3.5 | 0.5 | 40 | 15 | 65 |
| Inventive Example 4 | bal | 1 | 2 | 50 | 15 | bal | — | — | — | | 60 |
| Comparative Example 3 | bal | 17 | 0.5 | 37 | 10 | bal | 19.0 | 1 | 0 | 15 | 27 |
| Inventive Example 5 | bal | 15 | 1 | 38 | 15 | bal | 17.0 | 1.2 | 34 | 5 | 50 |
| Inventive Example 6 | bal | 12 | 2 | 39 | 17 | bal | 14.0 | 1.5 | 35 | 3 | 45 |
| Inventive Example 7 | bal | 10 | 3 | 48 | 20 | bal | — | — | — | | 40 |
| Comparative Example 4 | bal | 23 | 1.5 | 35 | 5 | bal | 25.0 | 1 | 0 | 10 | 24 |
| Inventive Example 8 | bal | 20 | 2 | 35 | 20 | bal | 22 . 0 | 1.5 | 32 | 4 | 42 |
| Inventive Example 9 | bal | 18 | 3 | 36 | 15 | bal | 20.0 | 2 | 33 | 3 | 36 |
| Inventive Example 10 | bal | 15 | 5 | 40 | 25 | bal | — | — | — | | 31 |
| Comparative Example 5 | bal | 27 | 2 | 33 | 10 | bal | 29.0 | 1 | 0 | 20 | 17 |
| Comparative Example 6 | bal | 25 | 4 | 34 | 10 | bal | 27.0 | 2 | 30 | 18 | 10 |
| Comparative Example 7 | bal | 23 | 5 | 35 | 12 | bal | 25.0 | 3 | 31 | 16 | 27 |
| Comparative Example 8 | bal | 22 | 6 | 35 | 30 | — | — | — | — | | 25 |

As*: A ratio [%] of an area occupied by the base steel sheet in a region from a surface roughness center line of the alloy-plated layer to 3/4t, where t is a distance from the surface roughness center line of the alloy-plated layer to the lowest line of the alloy-plated layer Meanwhile, in the aluminum alloy-plated steel sheet manufactured by the method described above, as a case where the alloy-plated layer was formed in a single layer or two layers, the content of each component in each of the first alloy-plated layer and the second alloy-plated layer and the thickness were measured. The results are shown in Table 3. The component in the plated layer was measured by point analysis with energy dispersive spectroscopy (EDS), and the thickness was obtained by measuring the thickness of the cross section with an electron microscope.

In addition, the alloy phase in the alloy-plated layer of Inventive Example 4 formed in a single layer was analyzed by an X-ray diffraction (XRD) method, and it was confirmed that the alloy-plated layer was formed of 80% or more of an $Fe_2Al_5$ alloy phase.

In addition, the alloy phase in the alloy-plated layer of Inventive Example 1 formed in two layers was also analyzed by the X-ray diffraction (XRD) method and EDS analysis, and it was confirmed that the first alloy-plated layer was mainly formed of an $Fe_2Al_5$ alloy phase and the second alloy-plated layer was formed of 80% or more of an $FeAl_3$ alloy phase.

A ratio of the upper plated layer occupied in the entire plated layer in the plated steel sheet manufactured as described above was measured as a ratio of the thickness of the cross section using a scanning electron microscope. The result is shown in Table 4. In addition, in order to evaluate physical properties of the plated steel sheet, the ratio of the upper plated layer, the seizure resistance, the corrosion resistance, and the plating adhesion were evaluated by the following methods.

[Seizure Resistance]

The manufactured plated steel sheet was heated under a condition of 900° C. for 5 minutes to evaluate physical properties of the plating, and then, whether or not the alloy-plated layer was fused to a die was visually observed. The evaluation was performed based on the following criteria.

○: No seizure x: Occurrence of adsorption on die due to hot-dip of plated layer

[Corrosion Resistance]

The plated steel sheet was subjected to a salt spray test and then was left for 720 hours. Thereafter, a corrosion product formed on the surface was removed, and then, a maximum depth of the corrosion product formed on the surface was measured.

Corrosion Resistance: After the salt spray test was performed for 720 hours, the corrosion product formed on the surface was removed, the depth of the corrosion product formed by the corrosion was measured, and a case where the depth was equal to or less than the standard (70 μm) as described below was expressed as good.

○: 70 μm or less x: More than 70 μm

[Plating Adhesion]

The plating adhesion was measured by converting the degree of the plated layer peeled off due to cracks generated when a shear stress was applied to the plated layer into a weight through a one surface friction experiment of the plated layer after the alloying. The plating adhesion was evaluated based on the following criteria.

○: 0.5 g/m$^2$ or less x: More than 0.5 g/m$^2$

TABLE 4

| | Ratio of upper plated layer (%) | Seizure resistance | Corrosion resistance | Plating adhesion | Structure of plated layer |
|---|---|---|---|---|---|
| Comparative Example 1 | 55% | x | x | ○ | Two layers |
| Inventive Example 1 | 33% | ○ | ○ | ○ | Two layers |
| Comparative Example 2 | 60% | x | x | ○ | Two layers |
| Inventive Example 2 | 95% | ○ | ○ | ○ | Two layers |
| Inventive Example 3 | 75% | ○ | ○ | ○ | Two layers |
| Inventive Example 4 | 0% | ○ | ○ | ○ | Single layer |
| Comparative Example 3 | 60% | x | ○ | ○ | Two layers |
| Inventive Example 5 | 25% | ○ | ○ | ○ | Two layers |
| Inventive Example 6 | 15% | ○ | ○ | ○ | Two layers |
| Inventive Example 7 | 0% | ○ | ○ | ○ | Single layer |
| Comparative Example 4 | 67% | x | ○ | ○ | Two layers |
| Inventive Example 8 | 17% | ○ | ○ | ○ | Two layers |
| Inventive Example 9 | 17% | ○ | ○ | ○ | Two layers |
| Inventive Example 10 | 0% | ○ | ○ | ○ | Single layer |
| Comparative Example 5 | 67% | x | ○ | x | Two layers |
| Comparative Example 6 | 64% | ○ | ○ | x | Two layers |
| Comparative Example 7 | 57% | ○ | ○ | x | Two layers |
| Comparative Example 8 | 0% | ○ | ○ | x | Single phase |

As shown in Tables 1 to 4, in the cases of Inventive Examples 1 to 10 where the composition of the plating bath and the alloying conditions that were defined in the present disclosure were satisfied, all the seizure resistance, the corrosion resistance, and the plating adhesion were excellent, and thus, seizure of the plated layer to a press die or a roll caused during the heat forming or generation of microcracks was prevented.

On the other hand, in the cases of Comparative Examples 1 to 8 where the content of Zn in the plating bath that was defined in the present disclosure was not satisfied or the alloying conditions were not satisfied, one or more physical properties of the seizure resistance, the corrosion resistance, and the plating adhesion were not excellent, and thus, the problems such as the seizure of the plated layer to the press die and the roll caused during the heat forming or the generation of the microcracks were caused.

Meanwhile, FIG. 1 illustrates a photograph obtained by observing the cross section of the aluminum-plated steel sheet of an additional experimental example in which 7% of Si was added to the aluminum plating bath according to the related art with a scanning electron microscope. In this case, a ratio of an area occupied by the base steel sheet in a region from a surface roughness center line of the alloy-plated layer to 3/4t was less than 30%.

Meanwhile, FIG. 2 is a photograph obtained by observing the cross section of the aluminum alloy-plated steel sheet manufactured by Inventive Example 1 with a scanning electron microscope, and illustrates an example where the alloy-plated layer is formed two layers. It was confirmed that the boundary between the alloy-plated layer and the base steel sheet that was a base material was formed in a sawtooth shape by addition of Zn, and thus, the ratio of the area occupied by the base steel sheet in the region from the surface roughness center line of the alloy-plated layer to 3/4t was 30% or more.

In addition, FIG. 3 is a photograph obtained by observing the cross section of the aluminum alloy-plated steel sheet manufactured by Inventive Example 6 with a scanning electron microscope. Similarly, the boundary between the alloy-plated layer and the base steel sheet that was a base material was formed in a sawtooth shape by addition of Zn, and thus, the ratio of the area occupied by the base steel sheet in the region from the surface roughness center line of the alloy-plated layer to 3/4t was also 30% or more.

1: Heat treatment furnace

2: Aluminum plating bath

3: Cooling apparatus

4: Alloy heat treatment apparatus

The invention claimed is:

1. An aluminum alloy-plated steel sheet comprising:

a base steel sheet; and a single alloy-plated layer formed on the base steel sheet, wherein the alloy-plated layer contains, by wt %, 35 to 50% of Fe, 1 to 20% of Zn, 5% or less of Mn, less than 0.1% of Si, and a balance of Al and unavoidable impurities, and a ratio of an area occupied by the base steel sheet in a region from a surface roughness center line of the alloy-plated layer to 3/4t is 30% or more, where t is a distance from the surface roughness center line of the alloy-plated layer to the lowest line of the alloy-plated layer.

2. An aluminum alloy-plated steel sheet comprising:

a base steel sheet; and an alloy-plated layer formed on the base steel sheet, wherein the alloy-plated layer includes:

a first alloy-plated layer that contains, by wt %, 35 to 50% of Fe, 1 to 20% of Zn, 5% or less of Mn, less than 0.1% of Si, and a balance of Al and unavoidable impurities; and a second alloy-plated layer that contains, by wt %, 30 to 40% of Fe, 1 to 22% of Zn, 2% or less of Mn, less than 0.1% of Si, and a balance of Al and unavoidable impurities, and a ratio of an area occupied by the base steel sheet in a region from a surface roughness center line of the alloy-plated layer to 3/4t is 30% or more, where t is a distance from the surface roughness center line of the alloy-plated layer to the lowest line of the alloy-plated layer.

3. The aluminum alloy-plated steel sheet of claim 1, wherein a thickness of the alloy-plated layer is 5 to 25 μm.

4. The aluminum alloy-plated steel sheet of claim 1, wherein the alloy-plated layer contains 80% or more of an $Fe_2Al_5$ alloy phase.

5. The aluminum alloy-plated steel sheet of claim 1, wherein a content of Al in the alloy-plated layer is 40 to 60%.

6. The aluminum alloy-plated steel sheet of claim 2, wherein a content of Zn in the second alloy-plated layer is higher than a content of Zn in the first alloy-plated layer.

7. The aluminum alloy-plated steel sheet of claim 2, wherein a content of Zn in the first alloy-plated layer is 1 to 20%, and a content of Zn in the second alloy-plated layer is 1.5 to 22%.

8. The aluminum alloy-plated steel sheet of claim 2, wherein a content of Al in the first alloy-plated layer is 40 to 60%, and a content of Al in the second alloy-plated layer is 40 to 65%.

9. The aluminum alloy-plated steel sheet of claim 2, wherein a thickness of the first alloy-plated layer is 1 to 25 μm, and a thickness of the second alloy-plated layer is 4 to 20 μm.

10. The aluminum alloy-plated steel sheet of claim 2, wherein the first alloy-plated layer contains 80% or more of an $Fe_2Al_5$ alloy phase, and the second alloy-plated layer contains 80% or more of an $FeAl_3$ alloy phase.

11. The aluminum alloy-plated steel sheet of claim 1, wherein the base steel sheet contains, by wt %, 0.05 to 0.3% of C, 0.1 to 1.5% of Si, 0.5 to 8% of Mn, 50 ppm or less of B, and a balance of Fe and unavoidable impurities.

12. A method for manufacturing an aluminum alloy-plated steel sheet used for hot press forming, the method comprising:

preparing a base steel sheet;

dipping the base steel sheet in an aluminum plating bath that contains, by wt %, 3 to 30% of Zn, less than 0.1% of Si, and a balance of Al and unavoidable impurities to obtain an aluminum-plated steel sheet;

performing cooling by supplying air heated to 200 to 300° C. to the aluminum-plated steel sheet after the aluminum plating to form an oxide film on a surface of the aluminum-plated steel sheet; and obtaining an aluminum alloy-plated steel sheet by on-line alloying in which heat treatment is performed after the cooling while maintaining the aluminum-plated steel sheet in a heating temperature range of 650 to 750° C. for 1 to 20 seconds.

13. The method of claim 12, wherein an alloying temperature is controlled to satisfy the following Relational Expression 1:

$$150-0.4\times[T]+3.3\times10-4\times[T]^2-0.38\times[\text{wt \% Zn}]\leq[\text{wt \% Fe}]\leq180-0.4\times[T]+3.3\times10-4\times[T]2-0.38\times[\text{wt \% Zn}] \quad \text{[Relational Expression 1]}$$

wherein [T] represents an alloy heat treatment temperature (° C.), [wt % Zn] represents a content of Zn wt % in the plating bath, and [wt % Fe] represents a content of Fe wt % in an alloy-plated layer.

14. The method of claim 12, wherein the oxide film is formed on the surface of the aluminum-plated steel sheet at a thickness of 10% or more of the entire thickness of a hot-dip aluminum-plated layer.

15. A hot-formed member obtained by subjecting the aluminum alloy-plated steel sheet of claim 1 to hot press forming.

* * * * *